United States Patent [19]

Greeves et al.

[11] Patent Number: 4,874,301

[45] Date of Patent: Oct. 17, 1989

[54] FUEL PUMPING APPARATUS

[75] Inventors: Godfrey Greeves, Hatch End; James C. Potter, London; Richard J. Andrews, Guildford; Kenneth M. Harris, Maidstone, all of England

[73] Assignee: Lucas Industries Public Limited Company, Birmingham, England

[21] Appl. No.: 159,397

[22] Filed: Feb. 23, 1988

[30] Foreign Application Priority Data

Mar. 14, 1987 [GB] United Kingdom ..... 8706090
Jan. 16, 1988 [GB] United Kingdom ..... 8800958

[51] Int. Cl.[4] ..... F02M 41/14

[52] U.S. Cl. ..... 417/462; 417/251; 417/443

[58] Field of Search ..... 417/251, 443, 462

[56] References Cited

U.S. PATENT DOCUMENTS 2,922,370 1/1960 Bischoff ..... 417/462 X
2,989,003 6/1961 Evans ..... 417/462 X
4,499,884 2/1985 Skinner ..... 417/462 X
4,550,702 11/1985 Djordjevic ..... 417/462 X

FOREIGN PATENT DOCUMENTS 990695 4/1965 United Kingdom ..... 417/462
1476629 6/1977 United Kingdom ..... 417/462

*Primary Examiner*—Michael Koczo
*Attorney, Agent, or Firm*—Balough, Osann, Kramer, Dvorak, Genova & Traub

[57] ABSTRACT

A fuel pumping apparatus for supplying fuel to an internal combustion engine comprises a rotary distributor member mounting a pumping plunger slidable in a bore and moved inwardly to discharge fuel from the bore by cam lobes on the internal surface of a cam ring, the cam lobes acting on the plunger through a cam follower. A valve is provided which at a predetermined position during the inward movement of the plunger, is opened to lower the pressure in the bore and thereby to terminate fuel flow through an outlet. The valve is actuated by the cam lobes either from the cam follower or from the plunger.

17 Claims, 6 Drawing Sheets

FUEL PUMPING APPARATUS

Figure 1:
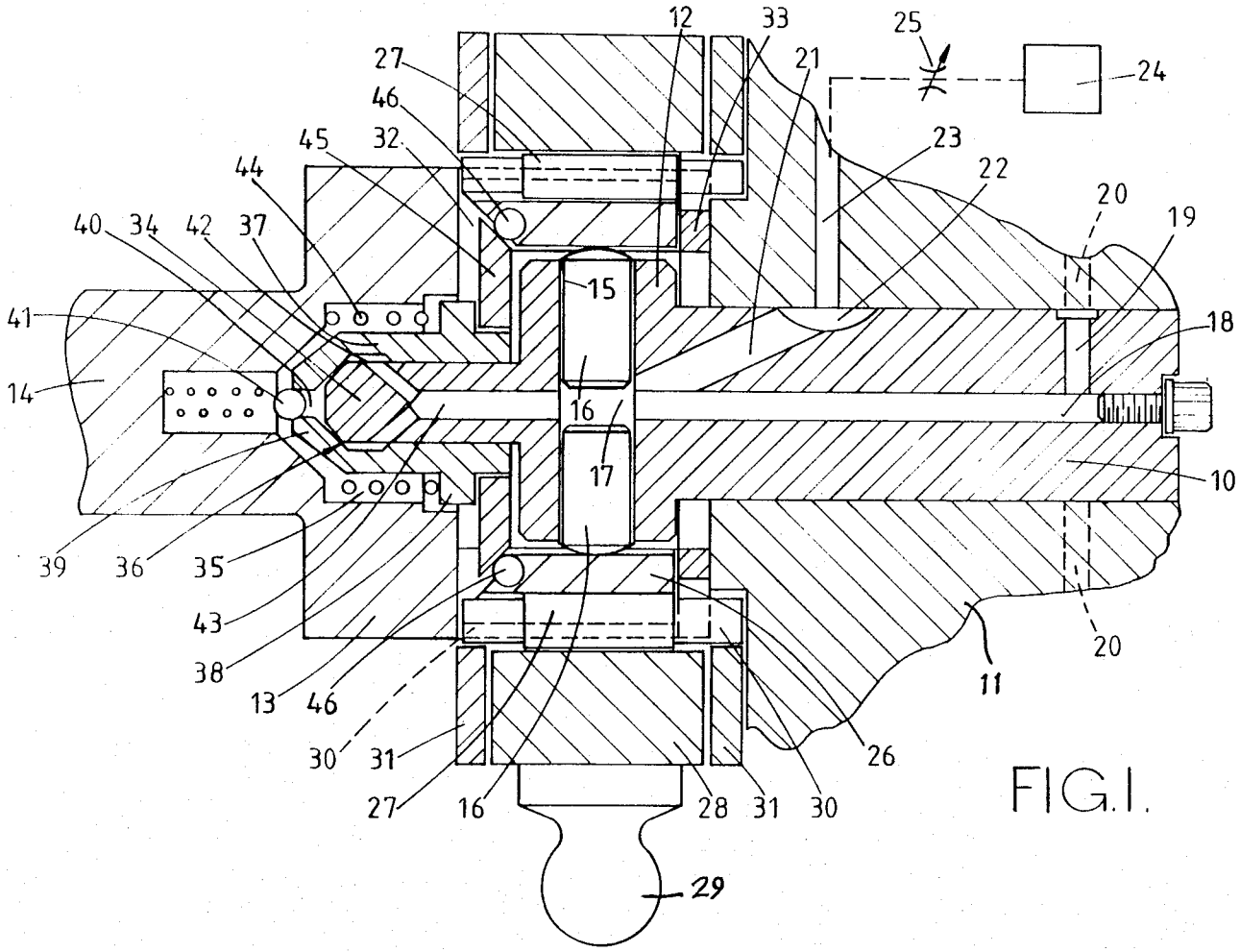

This invention relates to a rotary distributor pumping apparatus for supplying fuel to an internal combustion engine, the apparatus being of the kind comprising a rotary distributor member housed in a body, a drive shaft coupled to the distributor member and arranged in use to be driven in timed relationship with an associated engine, a plunger located within a bore in the distributor member, and a plurality of cam lobes housed in the body for imparting inward movement to the plunger as the distributor member rotates, means for feeding fuel to the bore to effect outward movement of the plunger and means for distributing fuel displaced from the bore during successive inward movements of the plunger to a plurality of outlet ports in turn.

Such apparatus is well known in the art and in most known forms of the apparatus the termination of fuel delivery through the outlets occurs as a roller connected to the plunger rides over the crest of the cam lobes. The reduction in fuel pressure which allows the valve members of the fuel injection nozzles connected to the outlet ports respectively, to close therefore occurs at a slow rate as compared with an apparatus in which the reduction of fuel pressure occurs as a result of the deliberate spilling of fuel. The rate of reduction of the fuel pressure can be increased by altering the profile of the crest of the cam lobes but the alterations of profile result in increased mechanical stress in the material forming the lobes and the roller.

Various proposals have been made to provide for fuel spillage in a distributor type pumping apparatus. U.S. Pat. No. 2,922,370 and British specification No. 990695 show such apparatus in which the plungers are constructed so as to form the valve means for a spill path from the pumping chamber defined between the plungers. The provision of the ports and passageways which are required, increases the problem of leakage between the plungers and the wall of the bore in which they are located and also introduces the problem of erosion. British specification Nos. 1476629 and 2131102 (U.S. Pat. No. 4,499,884) each show the provision of a spill control valve mounted radially in the distributor member. In each case the control valve is mounted in a diametrically disposed drilling in the distributor member at a position offset from the bore containing the pumping plungers and a special set of cam lobes are provided to operate the valve therefore adding materially to the cost of the apparatus.

The object of the present invention is to provide an apparatus of the kind specified in which termination of fuel delivery is obtained by spillage of fuel.

According to the invention an apparatus of the kind specified comprises a valve member carried by the distributor member and movable relative thereto, the valve member being shaped to engage with a seating to prevent the flow of fuel through a spill path from said bore and mechanical means operable by said cam lobes for moving the valve member away from the seating to open said spill path, the spill path being opened before the inward movement of the plunger under the action of a cam lobe has been completed.

Figure 2:
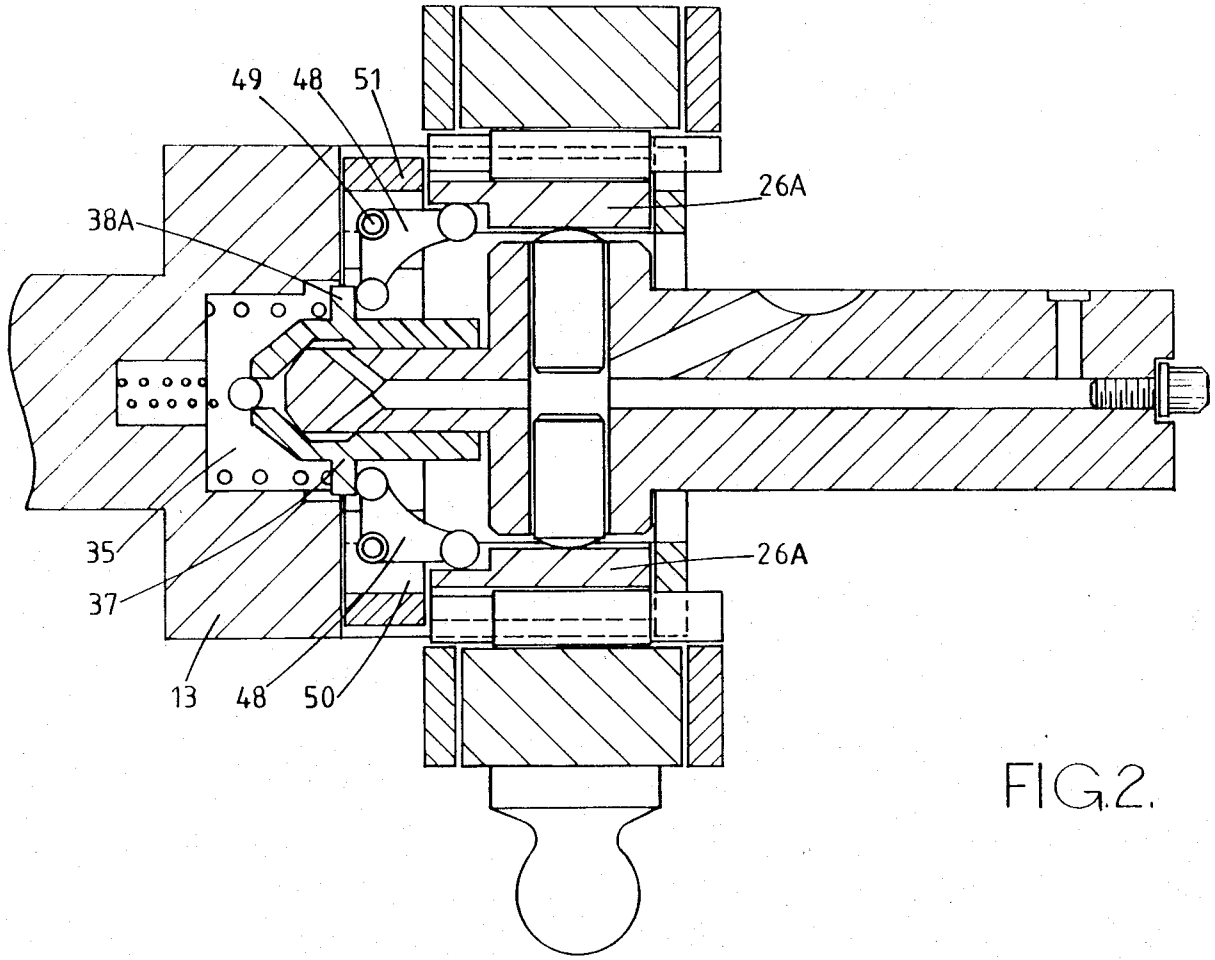
Figure 3:
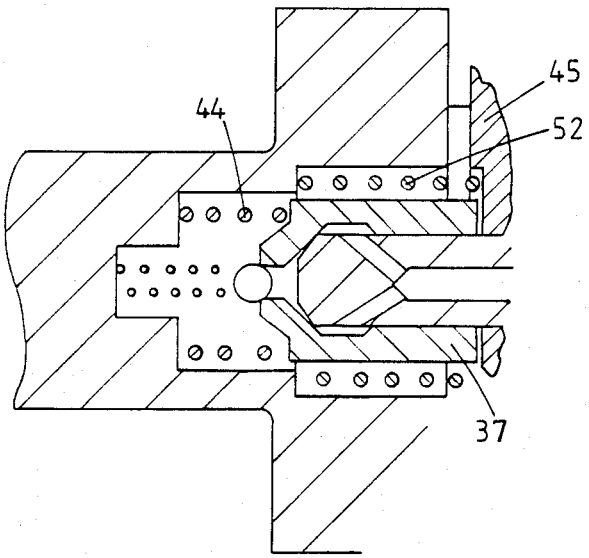
Figure 5:
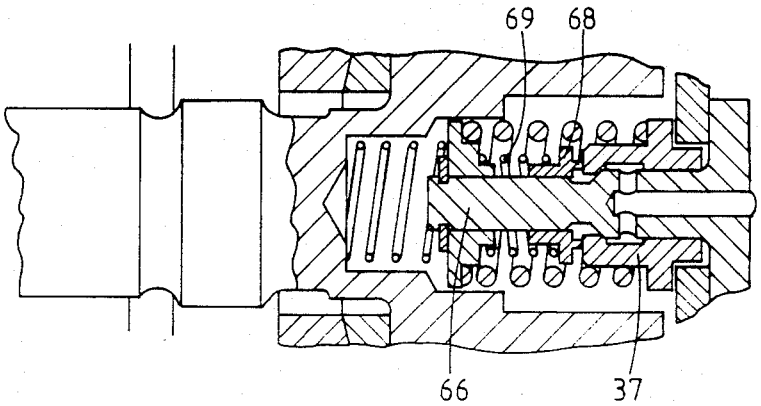
Figure 4:
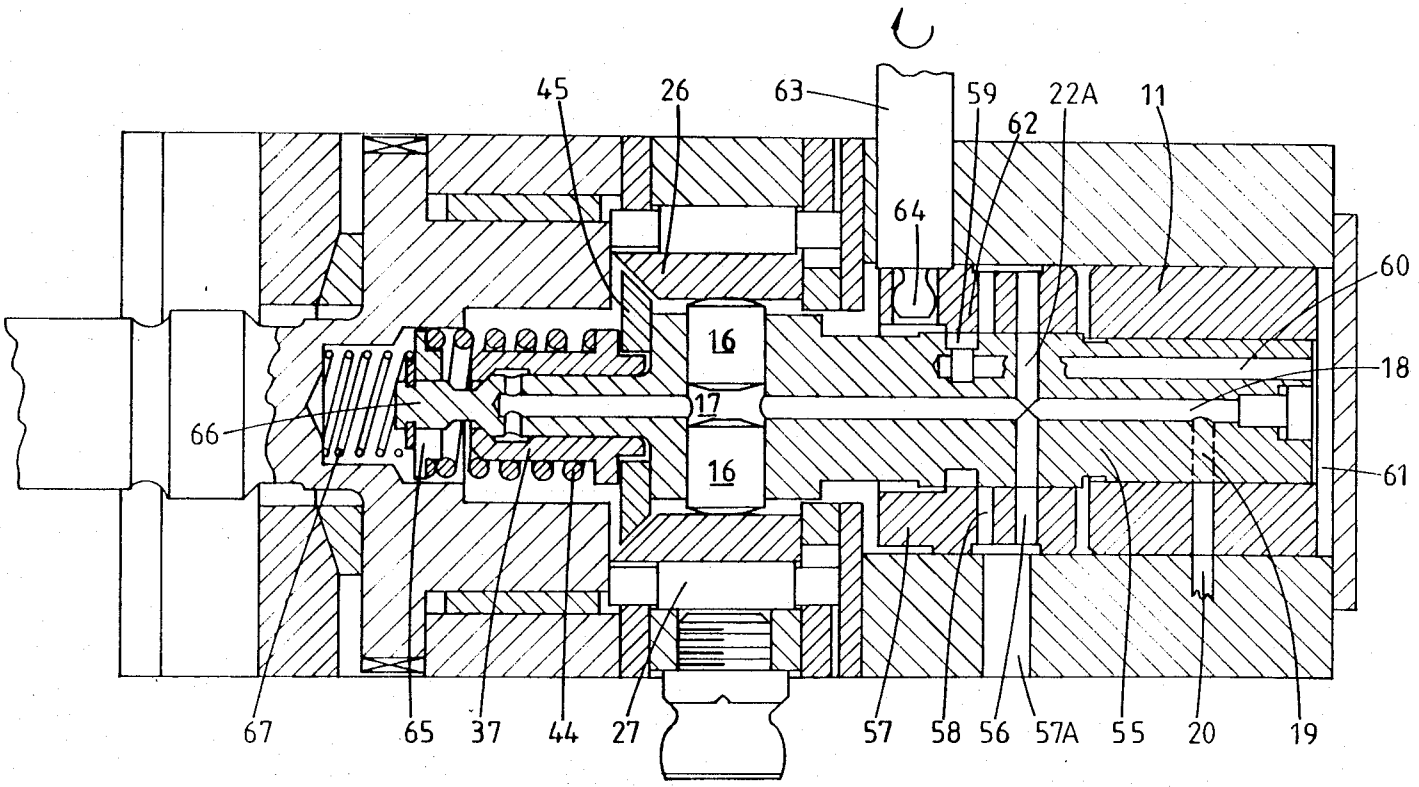
Figure 6:
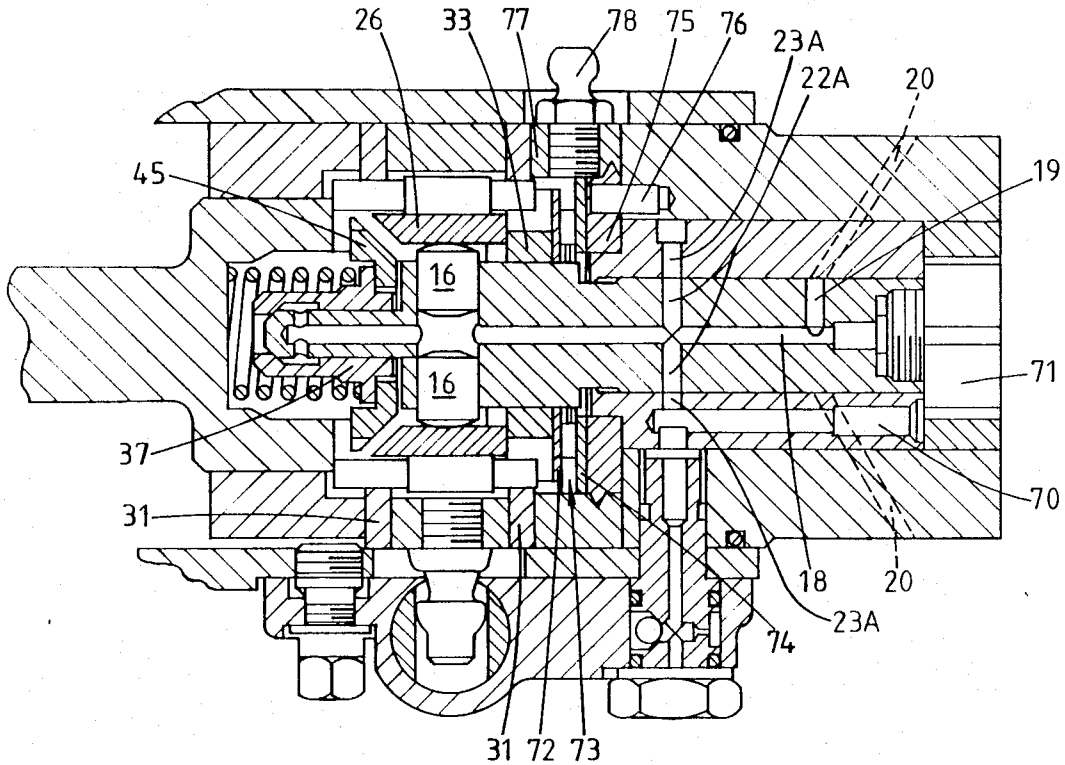
Figure 7:
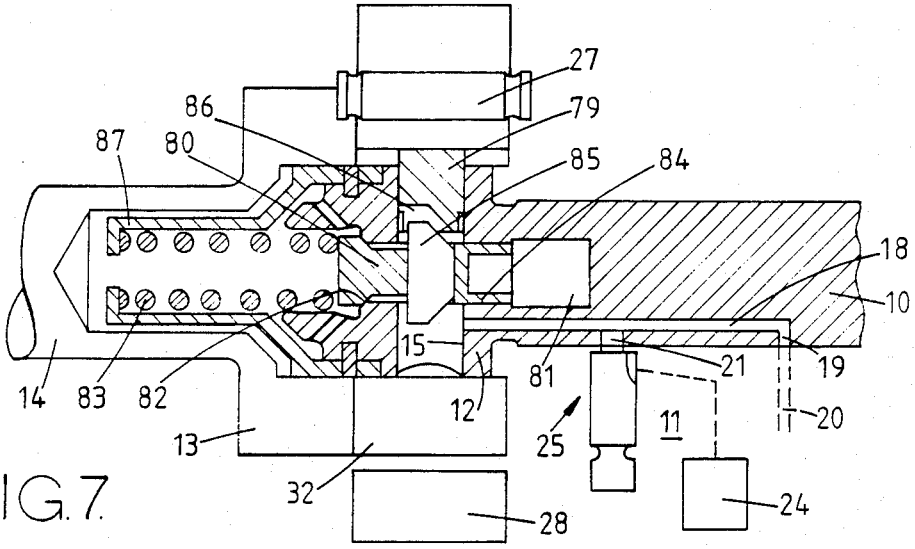
Figure 8:
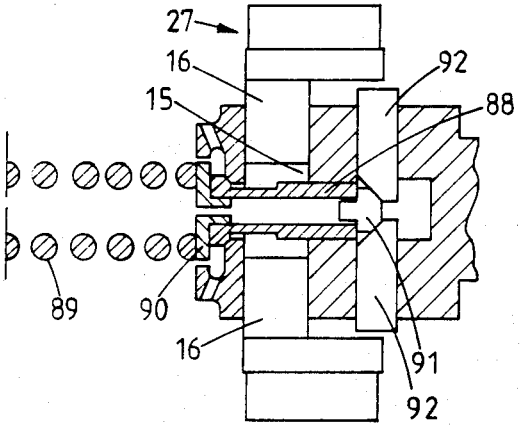
Figure 9:
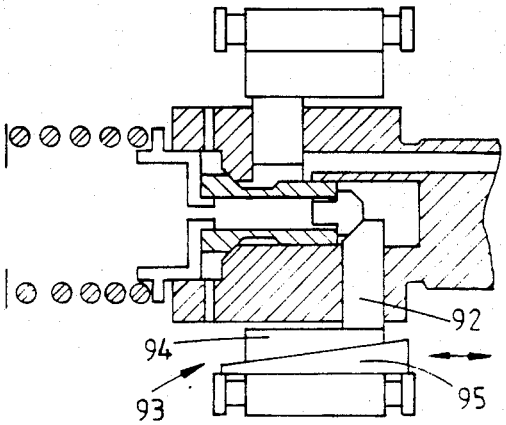
Figure 10:
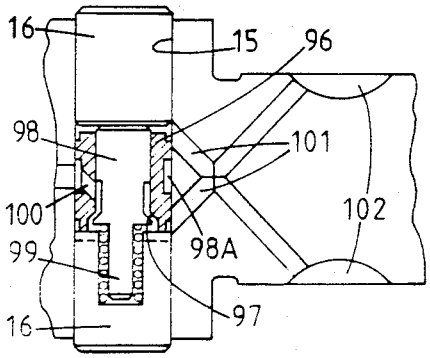

Examples of pumping apparatus in accordance with the invention will now be described with reference to the accompanying drawings in which:

FIG. 1 is a sectional side elevation of part of one example of an apparatus, FIG. 2 is a view similar to FIG. 1 showing a modification to the operating mechanism for a spill control valve, FIG. 3 is a view showing a modification to the apparatus seen in FIG. 1, FIG. 4 is a sectional side elevation showing another example of the apparatus, FIG. 5 shows a modification to part of the apparatus seen in FIG. 4, FIG. 6 shows in sectional side elevation a further example of the apparatus, and FIGS. 7 and 8 show in part sectional side elevation two further examples of the apparatus, FIG. 9 shows a modified form of the apparatus of FIG. 8, and FIG. 10 shows a further example of the apparatus.

Referring to FIG. 1 of the drawings the pumping apparatus comprises a rotary distributor member 10 which is mounted within a body 11. The distributor member is provided with an enlarged portion 12 which is located within a cup-shaped member 13 forming part of a drive shaft 14 which is adapted to be driven in timed relationship with the associated engine. The distributor member is coupled to the drive shaft so as to rotate therewith but is axially fixed within the body 11.

The enlarged portion of the distributor member is provided with a diametrically disposed bore 15 in which is located a pair of pumping plungers 16. The space 17 between the plungers forms the pumping chamber of the apparatus and it communicates with a plugged axially extending drilling 18 in the distributor member and with which communicates a radially disposed delivery passage 19. The passage 19 is positioned to register with outlet ports 20 in turn, the ports in use being connected to the injection nozzles respectively of the associated engine.

Also communicating with the pumping chamber 17 is a passage 21 which terminates in a groove 22 on the periphery of the distributor member and the groove is arranged to register with a plurality of fuel inlet ports 23 only one of which is shown, formed in the body and equal in number to the number of outlets. The inlet ports 23 communicate with a source 24 of fuel under pressure and a throttle 25 is provided to control the flow of fuel through the inlet ports.

At the outer ends of the plungers are located cam followers, each cam follower comprising a shoe 26 which mounts a roller 27 and the rollers are positioned to engage with the internal peripheral surface of an annular cam ring 28 which is mounted for angular adjustment within the body. The cam ring is provided with a peg 29 which is coupled to a piston (not shown) which is responsive to a pressure which varies with the speed of the associated engine. The rollers 27 are provided with extensions 30 of reduced diameter, the extensions being arranged to engage with the internal peripheral surfaces of a pair of stop rings 31 positioned at the opposite ends of the cam ring. The cam followers are located within slots 32 formed in the skirt portion of the cup-shaped member 13. In this manner the cam followers are driven directly by the drive shaft in known manner. The rollers are located against axial movement by the abutment of the extensions 30 with the base wall of the cup-shaped member and a recessed portion of the body respectively and the shoes are located against axial movement in one direction i.e. towards the right as seen in FIG. 1, by a ring member 33 which rotates with the cup-shaped member.

The distributor member has cylindrical extension 34 which extends with clearance into a recess 35 in the drive shaft. The end portion of the extension 34 defines a truncated conical seating 36 and axially slidable about the extension 34 is a valve member in the form of a sleeve 37 having a flange 38 adjacent its end which is adjacent the enlarged portion 12 of the distributor member. The sleeve has an inwardly extending portion 39 at its end remote from the enlarged portion of the distributor member, the internal surface of the portion 39 being shaped for co-operation with the seating. Moreover, the inwardly extending portion defines a port 40 which is closable by a spring loaded ball valve 41. The internal surface of the sleeve 37 adjacent the inwardly extending portion 39 is relieved to define an annular space 42 which is permanently connected to the pumping chamber 17 by means of drillings 43 in the extension. In the closed portion of the sleeve as shown in FIG. 1, the end walls of the relieved portion 42 are of substantially identical area.

The sleeve is biased into contact with the seating by means of a coiled compression spring 44 one end of which engages with the flange 38 and the other end of which engages a step defined in the recess 35.

In order to move the sleeve 37 against the action of the spring 44 an annular plate member 45 is provided and this is loosely located about the portion of the sleeve intermediate the flange 38 and the end of the sleeve presented to the enlarged portion of the distributor member. The plate member has extensions which extend into the slots 32 and the outer surfaces of these extensions are obliquely formed and are engageable by tangentially disposed rollers 46 carried by the shoes 26 respectively.

Considering now the operation of the apparatus. As shown in FIG. 1 fuel is being supplied to the pumping chamber by way of one of the inlet ports 23 and the passage 21. The amount of fuel supplied depends upon the setting of the throttle 25 bu the maximum amount of fuel which can be supplied is determined by the abutment of the extensions 30 with the stop plates 31. As the distributor member rotates, the groove 22 is moved out of register with a port 23 and the passage 19 is brought into register with an outlet 20. As soon as this communication has been established, the plungers 16 are move inwardly by cam lobes on the internal peripheral surface of the cam ring 28 and fuel is expelled from the pumping chamber and is delivered to an injection nozzle of the associated engine. As the shoes move inwardly the rollers 46 contact the oblique surfaces on the plate member 45 which therefore starts to move towards the left as seen in the drawings, until the clearance between the plate member and the flange 38 has been taken up. Further inward movement of the cam followers will then cause axial movement of the sleeve 37 resulting in the lifting of the inwardly extending portion 39 of the sleeve from the seating surface 36 and as soon as this takes place fuel spills through the passage 43 and through the port 40 thereby causing a rapid reduction in the pressure of fuel in the pumping chamber 17. The rapid reduction of the fuel pressure allows the valve in the injection nozzle to close quickly to terminate the flow of fuel through the engine. Further inward movement of the plungers will take place after the spill path has been opened and the displaced fuel will of course flow to the interior of the body 11. With continued rotation of the distributor member the passage 19 moves out of register with the port 20 and the groove 22 moves into register with another inlet port 23 to permit filling of the pumping chamber as described. Moreover, the sleeve 37 will be moved to the closed position by the action of the spring 44.

With this arrangement therefore the termination of fuel flow to the associated engine occurs quickly and before the rollers 27 move over the crests of the cam lobes on the cam ring 28. The purpose of the valve 41 is to limit the rate of spillage of fuel from the pumping chamber in order to minimise the formation of cavities in the fuel and also to prevent fuel flow through the port 40 during the initial portion of the filling strokes of the plungers before the sleeve has moved to the closed position. In the closed position of the sleeve and during the delivery of fuel to the engine the pressure in the annular space 42 is equal to the pressure in the pumping chamber. However, the fact that the end areas of the space 42 are substantially equal means that the sleeve is substantially pressure balanced and any slight imbalance in the direction to open the sleeve, is taken care of by the spring 44.

The leakage path between the interior surface of the sleeve 37 and the extension 34 is of substantial length so that fuel leakage is minimised.

The plate member 45 is deliberately made to be a loose fit about the sleeve so as to avoid any problems with eccentricity for example in the cam ring 28.

Although as described the surfaces engaged by the rollers 46 are oblique they may be of convex form to allow the plate member to rock. Moreover the face of the plate member 45 which is presented to the flange 38 or the flange itself, may be of convex form.

In the arrangement shown in FIG. 2 the actuation of the sleeve 37 is achieved in a slightly different fashion and as seen in FIG. 2, the flange 38A upon the sleeve 37 has been moved to a position more or less within the recess 35. Bell crank levers 48 which are pivotally mounted at 49, are provided and the levers 48 are located within slots 50 formed in an annular support member which has outwardly extending projections 51 engaging in the slots in the cup-shaped member 13. The support member is able to move transversely in the slots to allow for manufacturing tolerances and in this case the shoes 26A are stepped to define surfaces for engagement with one arm of the respective bell crank lever, the other arms of the levers engaging the flange 38A.

FIG. 3 shows a modification to the example of FIG. 1 in which the plate member 45 engages with the end of the sleeve 37 and a separate spring 52 is provided to bias the plate member 45.

In the forms of apparatus described with reference to FIGS. 1, 2 and 3 the start of delivery of fuel varies in accordance with the quantity of fuel to be delivered to the associated engine. The end of delivery occurs at a constant time depending upon the setting of the cam ring 28. The examples of apparatus now to be described with reference to FIGS. 4 and 5 provide a constant start of delivery but a variable end of delivery dependent upon the quantity of fuel which is being supplied.

In the example shown in FIG. 4 identical reference numerals to those used in the earlier figures have been used wherever possible. In FIG. 4 the distributor member 55 is of increased axial length and is axially movable within the body 11. The pumping chamber 17 is connected by the passage 18 to the delivery passage 19 and to a plurality of inlet passages 22A which can register for the purpose of effecting outward movement of the plungers, with inlet ports 56 formed in a sleeve member 57 which surrounds the distributor. At their outer ends the ports 56 communicate with a circumferential groove which is in constant communication with a fuel supply port 57A connected in use to the source of fuel under pressure. Also extending inwardly from the groove are a plurality of supply ports 58 which can be uncovered to a circumferential groove 59 formed on the distributor member, when the sleeve member 57 is moved axially towards the left as shown in the drawing. The groove 59 by way of a passage 60, communicates with a chamber 61 defined at the end of the distributor member. The sleeve member defines a land 62 which has the same axial dimension as the groove 59. The sleeve member is axially movable by means of an angularly adjustable shaft 63 which has at its inner end, an eccentrically disposed peg 64 which is located in a hole in the sleeve member.

The sleeve 37 is constructed in the same manner as the sleeve shown in FIG. 1 and it is biased by a spring 44 but in this case the spring 44 engages with an abutment plate 65 mounted on a further extended portion 66 of the distributor member. The abutment plate conveniently is retained in position by a circlip and on its opposite side to that engaged by the spring 44, is engaged by a further spring 67 which locates against the step in the recess in the same manner as the spring 44 of the example of FIG. 1. The spring 67 biases the distributor member towards the right as shown in the drawing and when the apparatus is in use, the distributor member is moved towards the left by admitting fuel under pressure to the chamber 61. The admission of fuel under pressure is controlled by moving the sleeve member 57 and if the sleeve member is moved towards the left the groove 59 is brought into communication with the ports 58 so that fuel is supplied through the ports to the groove 59 and hence to the chamber 61. The distributor member will therefore move to the left and a follow up servo action is obtained. If the sleeve member is moved towards the right then the groove 59 is uncovered to the low pressure existing within the cavities in the body of the apparatus and fuel can escape from the chamber 61 as the distributor moves towards the right under the action of the spring 67.

In operation during the time when the ports 56 are in communication with the passages 22A, fuel is supplied to the pumping chamber 17 to move the plungers outwardly their maximum extent and this occurs each time the pumping chamber is filled with fuel. As the distributor member rotates therefore as soon as the cam followers engage the leading faces of the cam lobes, inward movement will be imparted to the plungers and fuel will be displaced to an outlet. Thus the timing of delivery of fuel for a given setting of the cam ring, is independent of the amount of fuel eventually supplied to the engine. As the plungers and cam followers move inwardly the cam followers will engage the plate member 45 which is thus moved towards the left to open the spill valve and permit spillage of fuel in the manner described with reference to FIG. 1. In this case however the position during the inward movement of the plungers and shoes at which the shoes engage the plate member 45 depends upon the axial position of the distributor member and if the distributor member is at a position to the left of that shown in FIG. 4, the engagement of the shoes with the plate 45 will occur later during the inward movement of the plungers, hence more fuel will be supplied to the associated engine. Similarly if the distributor member is to the right of that shown in FIG. 4, the instant at which the shoes engage with the plate will occur earlier during the inward movement of the plungers and therefore less fuel will be supplied to the associated engine.

It will be noted in FIG. 4 that the rollers carried by the shoes and intended for engagement with the plate 45 have been omitted and the end surfaces of the shoes are obliquely formed for co-operation with the oblique surfaces of the plate. It will also be noted that the spring loaded valve 41 controlling the spillage of fuel has been omitted. In this connection some control is effected by careful control of the clearance between the further extended portion 66 of the extension and the aperture in the sleeve 37.

In the arrangement shown in FIG. 5 the equivalent of the valve 41 of FIG. 1 has been inserted and it will be seen to constitute an outwardly flanged annular member 68 slidable on the extension 66 and having an axially extending sealing rib for engagement with the end surface of the sleeve 37. The member is biased towards the sleeve 37 by means of a spring 69.

It is possible to arrange for the sleeve 37 to be biased into engagement with the seating, by plungers (not shown) actuated by fuel under pressure which may be obtained from the source 24.

It is possible to obtain the constant start of fuel delivery provided by the examples of FIGS. 4 and 5 without resorting to a construction in which the distributor member is moved axially. An example of such an apparatus is seen in FIG. 6. In the example of FIG. 6 like reference numerals to those of FIG. 1 are used for parts which perform the same function. As seen in FIG. 6 the groove 22 is replaced by a plurality of inlet passages 22A which communicate with the passage 18. The passages 22A can communicate with inlet ports 23A which are in constant and direct communication with the outlet 70 of a fuel supply pump the rotor 71 of which is connected to the distributor member. The shoes 26 are engaged at one end by the ring 33 but in this case the ring is axially movable so as to be able to adjust the axial positions of the shoes.

For the purpose of the adjustment there is located against the ring 33 an annular hardened plate 72 which is engaged by a needle thrust race 73 also engaging a further hardened plate 74 which is engaged by a thrust member 75 in the form of a ring slidable axially about a reduced portion of the body. A pin 76 is provided to restrain the member 75 against angular movement. A part of the exterior surface of member 75 is provided with a screw thread profile which is engaged with a complementary thread form formed in a ring member 77 mounted for angular movement but restrained against axial movement in the body. The ring member is provided with a peg 78 so that its angular setting can be adjusted.

In operation, the instant at which the sleeve 37 is lifted from its seating to spill fuel will depend upon the axial setting of the shoes 26 and this depends by virtue of the screw connection between the ring member 77 and the thrust member 75, on the angular setting of the ring member. Thus the angular setting of the ring member determines the amount of fuel which is supplied to the associated engine.

In the arrangement so far described the valve member actuated to terminate delivery of fuel has been the form of a sleeve slidable on an extension of the distributor member.

Referring to FIG. 7 a valve member 80 is provided and this is slidable axially in the distributor member.

The valve member is housed in a bore 81 which traverses the bore 15 and defines a seating 82 for engagement under the action of a spring 83, by the head of the valve member. The valve member also includes a skirt portion 84 which guides its movement and it has a transverse opening in which is mounted a slidable reaction member 85 the ends of which locate within slots 86 formed in the inner ends of the plungers respectively. The ends of the reaction member 85 and the base walls of the slots 86 are inclined so that as the plungers move inwardly a position will be reached at which the inclined surfaces of the reaction member and the slots engage with each other to effect lateral movement of the valve member to lift the valve head from the seating 82. The effect of this is to allow fuel to be spilled from the bore 15, the spilled fuel flowing to a cavity within the body of the apparatus and in which the enlarged portion 13 and the cam followers are accommodated. This cavity is vented to the low pressure side of the pump 24. It is arranged that the end portions of the reaction member 85 and the slots 86 never completely disengage so that in the use of the apparatus the plungers and also the valve member 80 will be prevented from moving angularly about their respective axes. The fact that the reaction member is slidable means that in spite of manufacturing tolerances, both plungers 79 contribute to the movement of the valve member.

The spring 83 is located within a chamber formed in the part 13 and the drive shaft 14 and although the valve member 80 is substantially pressure balanced so far as the high pressure fuel is concerned, the spring if engaged with the drive shaft would impose a substantial end thrust on the distributor member and the drive shaft. This is avoided by the provision of a stirrup 87 which is engaged by the end of the spring remote from the valve member, the stirrup being secured to the distributor member.

An alternative way of moving the valve member is shown in FIG. 8, the valve member is indicated at 88 and is of tubular configuration. The spring 89 which biases the valve member engages with a spring abutment 90 which is located within the valve member but may be formed in one piece with the valve member, and at the opposite end of the valve member is a push piece 91 defining a tapered peripheral surface which is engaged by complementary inclined surfaces formed at the inner ends of a pair of actuating plungers 92 which are disposed in radial bores formed in the distributor member. The plungers 16 are of conventional construction and the cam followers 27 are offset so that after a predetermined inward movement of the pumping plungers 16, the cam followers engage the actuating plungers 92 to impart lateral movement to the valve member against the action of the spring 89. Such lateral movement lifts the valve member from the seating to allow fuel to escape from the bore 15 to the cavity within the body of the apparatus. The push piece 91 is a slack fit within the valve member to ensure that each actuating plunger 92 contributes equally to the movement of the valve member.

In FIG. 9 there is shown a modification to the example of FIG. 8 and in which the actuating plungers 92 are actuated by separate cam followers 93 each of which comprises a pair of wedge members 94, 95. The relative setting of the wedge members can be adjusted and this has the effect of altering the position during the inward movement of the followers, at which the actuating plungers 92 effect lateral movement of the valve member. With this arrangement it is possible to dispense with the throttle valve 25 so that the bore 15 containing the pumping plunger or plungers is completely filled with fuel. Relative adjustment of the wedge members therefore determines the quantity of fuel which is supplied to the associated engine and the start of injection of fuel occurs at the same time irrespective of the quantity of fuel which is supplied to the associated engine.

In the example of FIG. 10 the bore 15 intermediate the plungers 16 is fitted with an annular valve guide 96 the bore of which defines a seating 97. The guide is fixed within the bore 15 either by means of a set screw (not shown) or by virtue of the fact that it is an interference fit. Slidable in the bore in the guide is a valve member 98 having an extension 99 located within a recess in one of the plungers. The valve member is shaped for co-operation with the seating 97 and defines a waisted portion which by wa of a port 100 in the valve guide 96 is in constant communication with the cavity within the body by way of groove 98A and a port communicating with the cavity. The valve member 98 is biased by a spring located about the extension, into contact with the seating. The valve member and the valve member divide the bore into two parts which are interconnected by passages 101 which extend to inlet grooves 102. The passage which extends to the delivery passage 19 is not shown.

The upper one of the plungers as shown in the drawing engages the valve member 98 to lift it from the seating to allow escape of fuel from the two parts of the bore. The plungers are shown in their innermost positions and the lower one of the plungers is provided with a diametrical slot, shown in dotted outline, in its inner face to ensure that there is an adequate path for the flow of fuel when the valve member is lifted from its seating. Prior to the valve member being lifted from its seating the valve member is biased by the spring into contact with the seating and in addition, the fuel pressure acting on the differential end area also produces a force acting to bias the valve member into contact with the seating.

We claim:

1. A rotary distributor fuel pumping apparatus for supplying fuel to an internal combustion engine comprising a rotary distributor member housed in a body, a drive shaft coupled to the distributor member and driven in use in timed relationship with an associated engine, a plunger located within a bore in the distributor member, a plurality of cam lobes formed on a cam ring for imparting inward movement to the plunger as the distributor member is rotated, means for feeding fuel to the bore to effect outward movement of the plunger, further means for distributing the fuel displaced from the bore during successive inward movements of the plunger to a plurality of outlet ports in turn, characterised by a valve member carried by the distributor member and movable relative thereto, the valve member being shaped to engage with a seating to prevent the flow of fuel through a spill path from the bore, mechanical means operable by said cam lobes for moving the valve member away from the seating to open the spill path, the spill path being opened before the inward movement of the plunger under the action of a cam lobe has been completed.

2. An apparatus according to claim 1 characterised in that said valve member is in the form of a sleeve slidable about an extension of the distributor member said seating being defined at the end of the extension and the sleeve defining an inwardly extending portion for engagement with the seating.

3. An apparatus according to claim 2 including a cam follower interposed between the plunger and the cam lobes, and characterised in that said mechanical means comprises an annular plate member located about the extension and slidable axially relative thereto, the outer edge of said plate member defining an oblique form for engagement by a complementary form defined on a part carried by the cam follower, the plate member being moved axially upon engagement of said forms or by said form and said part, the axial movement of the plate being imparted to the sleeve.

4. An apparatus according to claim 3 characterised in that said plate member is mounted about the sleeve, the sleeve defining a flange which is engaged by said plate member.

5. An apparatus according to claim 2 including a cam follower interposed between the plunger and the cam lobes and characterised in that said mechanical means comprises a bell crank lever one arm of which can engage with a flange on the sleeve and the other arm of which is engageable by the cam follower said bell crank lever when the arms are engaged with the sleeve and the cam follower imparting axial movement of the sleeve during further inward movement of the cam follower.

6. An apparatus according to claim 2 characterised by an annular chamber defined between the sleeve and the extension, passage means connecting said chamber with the bore and means for controlling the rate of flow of fuel through said passage means when the sleeve is moved away from the seating.

7. An apparatus according to claim 6 chracterised in that the means for controlling fuel flow comprises a spring loaded valve associated with an opening in the sleeve.

8. An apparatus according to claim 6 characterised in that the means for controlling fuel flow comprises an opening in the sleeve and a shaped portion of the extension which extends through said opening.

9. An apparatus according to claim 3 characterised in that the cam follower is axially fixed in the body and the distributor member is axially movable in the body thereby to vary the instant during the inward movement of the cam follower at which axial movement is imparted to the sleeve.

10. An apparatus according to claim 3 characterised in that the distributor member is axially fixed within the body and a part of said cam follower is axially movable in the body thereby to vary the instant during the inward movement of the cam follower at which axial movement is imparted to the sleeve.

11. An apparatus according to claim 1 characterised in that said valve member is slidable in a further bore which traverses the bore containing the plunger.

12. An apparatus according to claim 11 characterised by a reaction member engaged with the valve member, said reaction member extending transversely to the valve member and having an end portion engaged within a slot formed in the inner end of the plunger, the end surface of the reaction member and the surface of the base wall of said slot being obliquely disposed whereby at a predetermined position during the movement of the plunger by a cam lobe said oblique surfaces will engage with each other to effect axial movement of the valve member.

13. An apparatus according to claim 12 characterised in that said reaction member is slidably located in a transverse opening in the valve member, the first mentioned bore mounting a further plunger which co-operates in the same manner as the first mentioned plunger, with the other end of the reaction member.

14. An apparatus according to claim 11 including a cam follower interposed between the plunger and the cam lobes and characterised by an actuating plunger mounted in the distributor member, the outer end of said actuating plunger being engageable by said cam follower and the inner end thereof being shaped for engagement with a push piece carried by the valve member, whereby when the actuating plunger is moved inwardly the axial movement will be imparted to the valve member.

15. An apparatus according to claim 14 characterised in that the cam follower includes a pair of relatively adjustable members whereby the position during movement of the cam follower by a cam lobe at which axial movement is imparted to the valve member can be varied.

16. An apparatus according to claim 1 characterised in that said valve member is slidable within a valve guide secured within the bore, the seating being defined on said valve guide and the valve member being engageable by the plunger to lift the valve member from the seating.

17. An apparatus according to claim 16 characterised by a further plunger in said bore, said sleeve being position between said plungers and a spring positioned between the further plunger and the valve member, the spring acting to urge the valve member into contact with the seating.

* * * * *